US006959674B2

(12) United States Patent
Fischer

(10) Patent No.: US 6,959,674 B2
(45) Date of Patent: Nov. 1, 2005

(54) VALVE OPERATING DEVICE FOR AN INTERNAL COMBUSTION ENGINE

(75) Inventor: Adolf Fischer, Haar (DE)

(73) Assignee: Bayerische Motoren Werke AG, Munich (DE)

( * ) Notice: Subject to any disclaimer, the term of this patent is extended or adjusted under 35 U.S.C. 154(b) by 166 days.

(21) Appl. No.: 10/716,403

(22) Filed: Nov. 20, 2003

(65) Prior Publication Data

US 2004/0168661 A1 Sep. 2, 2004

Related U.S. Application Data

(63) Continuation of application No. PCT/EP02/04175, filed on Apr. 16, 2002.

(30) Foreign Application Priority Data

May 23, 2001 (DE) ..... 101 25 082

(51) Int. Cl.[7] ..... F01L 1/34

(52) U.S. Cl. ..... 123/90.16; 123/90.15; 123/90.39; 74/569; 74/53

(58) Field of Search ..... 123/90.15–90.18, 123/90.39–90.59, 90.12; 74/569, 53, 54, 55

(56) References Cited

U.S. PATENT DOCUMENTS 5,695,430 A * 12/1997 Moyer ..... 477/189

6,085,704 A * 7/2000 Hara ..... 123/90.11

FOREIGN PATENT DOCUMENTS

| | | |
|---|---|---|
| DE | 42 08 335 A1 | 9/1994 |
| DE | 199 13 742 A1 | 9/2000 |
| GB | 1 419 876 | 12/1975 |
| JP | 59-041614 | 3/1984 |
| JP | 59-218316 | 12/1984 |
| JP | 7-103854 | 4/1995 |

* cited by examiner

*Primary Examiner*—Thomas Denion
*Assistant Examiner*—Jaime Corrigan
(74) *Attorney, Agent, or Firm*—Crowell & Moring LLP

(57) ABSTRACT

A valve gear mechanism for an internal combustion engine includes a camshaft in a separate cylinder head for controlling the stroke of a gas shuttle valve by means of an interposed rocker arm, which is mounted in the cylinder head of a piston that performs a lifting motion of a hydraulic valve-play compensation element. The aim of the invention is to achieve a play-free surface liaison of mechanical origin between the actuating elements of the gas shuttle valve. To achieve this, the piston of the hydraulic compensation element has a device that acts on an instrument for mechanically actuating a lifting stroke in order to achieve a play-free surface liaison of the contract surfaces of the rocker arm and an additional valve gear element, while the valve-play compensation element is maintained hydraulically without pressure.

10 Claims, 1 Drawing Sheet

VALVE OPERATING DEVICE FOR AN INTERNAL COMBUSTION ENGINE

CROSS REFERENCE TO RELATED APPLICATIONS

The present application is a continuation of international patent application no. PCT/EP02/04175, filed Apr. 16, 2002, published in German as WO 02/095193 A1, designating the United States of America, the entire disclosure of which is incorporated herein by reference. Priority is claimed based on Federal Republic of Germany patent application no. 101 25 082.7, filed May 23, 2001.

BACKGROUND AND SUMMARY OF THE INVENTION

The invention relates to a valve operating device for an internal combustion engine, which comprises a camshaft in a separate cylinder head of the internal combustion engine for controlling the stroke of a charge exchange valve by means of an interposed rocker arm which is journaled in the cylinder head on a reciprocating piston of a hydraulic valve clearance compensating element.

Especially in the case of valve operating devices with variable-stroke charge exchange valves, it is desirable especially for functional reasons to be able to measure the valve stroke of a charge exchange valve in each cylinder or the valve strokes of the corresponding charge exchange valve across all cylinders. In a valve operating device of a generic kind, having a rocker arm journaled on a hydraulic valve clearance compensating element, to provide for clearance-free surface-to-surface contact of all relevant contact surfaces in operation of the valves, it is necessary to supply hydraulic pressure to the valve clearance compensating elements via the associated lines in the separate cylinder head.

For any measurement of the valve operation at the end of the valve operating assembly of a mass-produced cylinder head, treatment with the amount of oil present in a cylinder head has to be put out without residue for clean continued operation at the cylinder head.

The invention is addressed to the problem of indicating a method for the measurement and/or adjustment of a valve operating device having a rocker arm supported on a valve clearance compensating element, which permits a perfect, clearance-free surface-to-surface contact between the contact surfaces of cooperating actuating elements of a charge exchange valve.

This problem is solved by Claim 1 in that the piston has a system for engagement of a tool for a mechanical valve lifting means for the clearance-free surface-to-surface engagement of contact surfaces of the rocker arm and the engagement of an additional valve operating element in the case if a valve clearance compensating element held without hydraulic pressure.

The advantage of the invention is that, for the measurement and adjustment of the valve operating device no hydraulic oil need to be supplied to the cylinder head; the measurement and adjustment is performed, so to speak, with a dry cylinder head. In the case of a serial measurement and adjustment, a separate hydraulic oil system is thus eliminated. It is also advantageous that the cylinder head passes on oil-free to the other working stations.

According to the invention, the tool can engage a link ball provided for the rocker arm on the piston, namely in the area of transition to a cylindrical section of the piston. In the embodiment of the invention it is furthermore proposed that the piston be equipped with a separate system for positive or frictional connection to the tool. As a preferred embodiment of the separate system, the piston of an partially oil-filled, deliverable valve clearance compensation element has an external circumferential groove between a guide section and a rocker arm joint head for engagement by a tool with a forked end section. This arrangement is advantageous for a low-profile valve clearance compensating element.

In further embodiment of the invention, the piston is operated in the stroke direction by a tool acting in a linear or rotary manner and/or a swiveling tool, the tool having pressure applied to it in order to sustain the surface-to-surface engagement between the contact surfaces on the valve operating side.

The piston configured according to the invention in a hydraulic valve clearance compensating element—HVA—finds, in further embodiment of the invention, use for a charge exchange valve equipped for variable stroke, wherein a rocker arm equipped with a wheel with a control track including an idle stroke cam and a stroke cam of a lever operated by the camshaft against the effect of a return spring, the starting position of which, corresponding to the particular stroke variation, is adjustable. A valve operating device of this kind, with a variable-stroke charge exchange valve is shown and described, for example, in DE 199 13 742 A1.

Lastly, in the final sub-claim there is described an operating method for the measurement and/or adjustment of a valve operating device with a charge exchange valve that has adjustable stroke.

BRIEF DESCRIPTION OF THE DRAWINGS

The invention is explained with the aid of a preferred embodiment represented in the drawing, wherein.

DETAILED DESCRIPTION OF THE PREFERRED EMBODIMENTS

Figure 1:
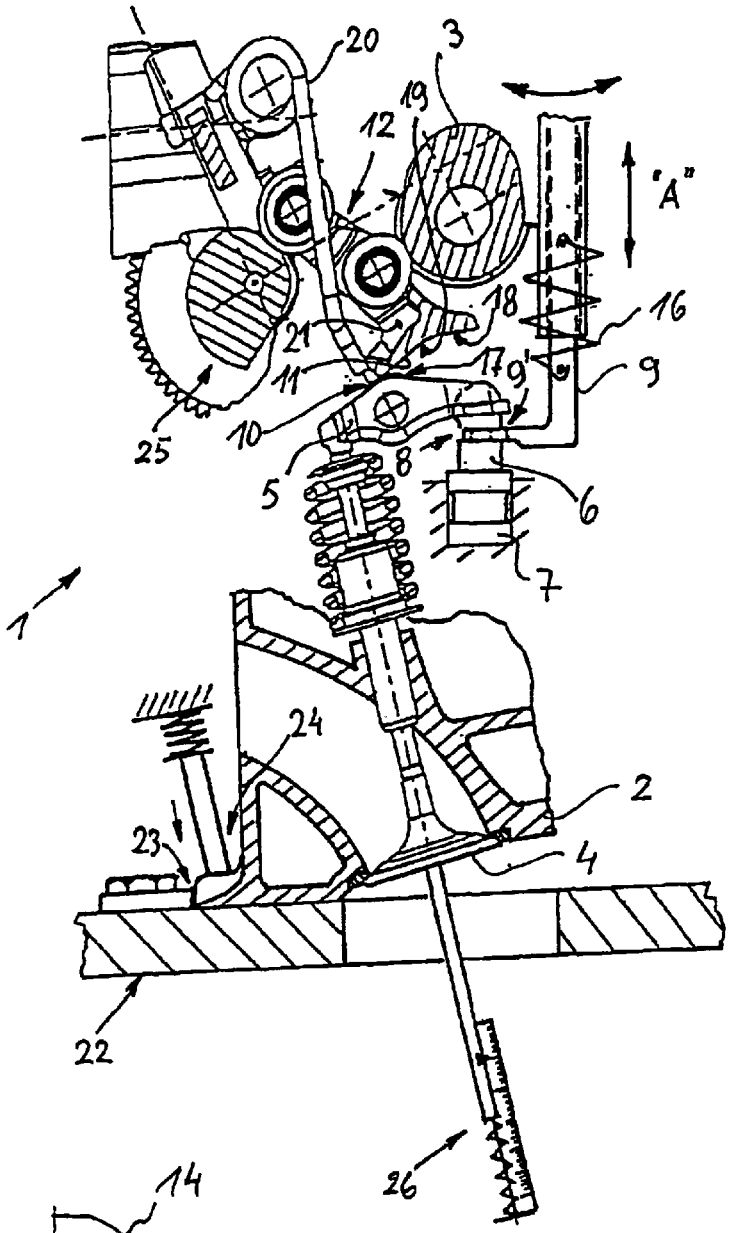
FIG. 1 shows a valve operating device with a variable-stroke charge exchange valve with a rocker arm, FIG. 2 a hydraulic valve clearance equalizing element with a piston configured according to the invention for supporting the rocker arm.
Figure 2:
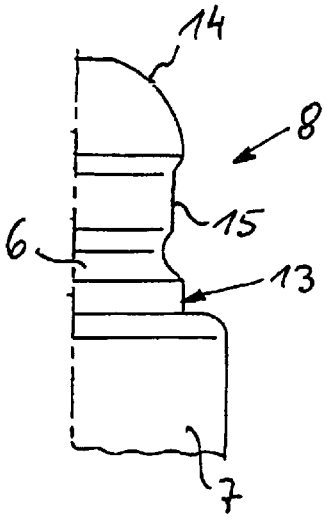

A valve operating device 1 for an internal combustion engine not shown comprises in a separate cylinder head 2 a camshaft 3 for controlling the stroke of a charge exchange valve 4 by means of an interposed rocker arm 5, which is journaled in the cylinder head 2 on a piston 6 with lifting motion of an HVA-7 hydraulic valve clearance compensating element.

For the measurement and/or adjustment of this valve operating device without delivering pressure of the HVA-7's to achieve a perfect surface-to-surface closure between working elements of the charge exchange valve 4, it is proposed according to the invention that the piston 6 of the HVA 7 have a device 8 for engagement of a tool 9 for a mechanical lifting action for the clearance-free surface-to-surface contact between contact surfaces 10 and 11 of the rocker arm 5 and an additional valve operating element 12 with the valve clearance compensating element or HVA 7 kept free of hydraulic pressure.

Preferably, the piston 6 of the HVA 7 is equipped with a separate device 8 for positive and/or non-positive connection to the tool 9.

In a preferred embodiment of the invention, an external circumferential groove 15 on a partially oil-filled valve clearance compensating element or HVA 7 is provided on the piston 6 as a separate device 8 between a guiding section 13 and a rocker arm joint head 14 for engagement by the tool 9 by means of a fork-like end section 9'.

To operate the piston 6 in the valve lifting direction, a tool 9 acting linearly according to arrow A can be provided, or else also a tool working circularly or by turning. In the case of a mechanically reciprocating piston 6, in order to maintain surface contact between the contact surfaces 10 and 11 on the valve, the tool 9 is biased by means of a tension spring 16.

As it can be seen in FIG. 1, the valve operating device 1 comprises a charge exchange valve 4 whose stroke is adjustable, in which case a rocker arm 5 equipped with a wheel 17 cooperates with a control track 19 comprising an idle stroke cam 11 and a lift stroke cam 18 of a lever 21 operated by the camshaft 3 against the action of a return spring 20; the starting position of the lever corresponding to the particular stroke variation is adjustable under control or regulation of a control system 25.

In order to measure and/or adjust the valve operating device 1, in a separate cylinder head 2, the latter is positioned at 23 in a device 22 without a hydraulic pressure connection for the HVA 7 and is fastened at 24; then the pistons 6 of all of the HVA 7 compensating elements are mechanically lifted by automatically deployed tools 9 to provide clearance-free surface-to-surface closure between the contact surfaces 10 and 11, with a force of contact controlled, for example, by a tension spring 16. Then all of the levers 21 of the variable-stroke valve operating device 1 are brought into position through the common control system 25 as regards their pivot points for a predetermined minimum stroke of the charge exchange valves 4, and then the camshaft 3 is coupled with a drive means, not shown, arranged in the apparatus 22, and is driven at a predetermined rotary speed. The charge exchange valves 4 thus operated are in working connection with extensometers 26 to measure the valve strokes, the individual values of which are displayed on a monitor with a given tolerance band and further documented.

The documentation of the valve stroke is not performed until after a certain run-in time of the valve operating device 1. In case of a valve stroke that is out of the tolerance range, the rocker arm of this charge exchange valve is replaced with another classified rocker arm 5.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. A valve operating device for an internal combustion engine, comprising a camshaft in a separate cylinder head of the internal combustion engine to control the stroke of a charge exchange valve with an interposed rocker arm which is journaled in the cylinder head on a reciprocating piston of a hydraulic valve clearance compensating element, wherein the piston has an arrangement for the engagement of a tool for a mechanical lifting action for a clearance-free surface-to-surface contact of surfaces of the rocker arm and of an additional valve operating element in the case of the valve clearance compensating element held without hydraulic pressure.

2. The device according to claim 1, wherein the piston is equipped with a separate device for positive and/or frictional engagement with the tool.

3. The device according to claim 2, wherein the piston of the valve clearance compensating element which can be supplied partially filled with oil has an external circumferential groove between a guiding section and a rocker arm joint head as a separate device having a fork-like end section for engagement by the tool.

4. The device according to claim 3, wherein the piston is operated in the lifting direction by the tool acting linearly or rotationally or rockingly, and to sustain the surface-to-surface junction between the contact surfaces on the valve operating side, force is applied to the tool.

5. The device according to claim 4, wherein the charge exchange valve is adjustable for various stroke lengths, the rocker arm is equipped with a wheel, with a control track including an idle stroke cam and a stroke cam of a lever operated by the camshaft against the action of a return spring, whose starting position corresponding to the particular stroke variation is adjustable under control/regulation.

6. The device according to claim 2, wherein the piston is operated in the lifting direction by the tool acting linearly or rotationally or rockingly, and to sustain the surface-to-surface junction between the contact surfaces on the valve operating side, force is applied to the tool.

7. The device according to claim 6, wherein the charge exchange valve is adjustable for various stroke lengths, the rocker arm is equipped with a wheel, with a control track including an idle stroke cam and a stroke cam of a lever operated by the camshaft against the action of a return spring, whose starting position corresponding to the particular stroke variation is adjustable under control/regulation.

8. The device according to claim 1, wherein the piston is operated in the lifting direction by the tool acting linearly or rotationally or rockingly, and to sustain the surface-to-surface junction between the contact surfaces on the valve operating side, force is applied to the tool.

9. The device according to claim 8, wherein the charge exchange valve is adjustable for various stroke lengths, the rocker arm is equipped with a wheel, with a control track including an idle stroke cam and a stroke cam of a lever operated by the camshaft against the action of a return spring, whose starting position corresponding to the particular stroke variation is adjustable under control/regulation.

10. A method for using a valve operating device comprising the steps of:

positioning and fixing a separated cylinder head in an apparatus without a hydraulic pressure connection;

mechanically lift-actuating pistons of all equalizing elements with automatically supplied tools for the clearance-free surface-to-surface connection of contact surfaces of a rocker arm and of an additional valve operating element with a controlled contact force, bringing all levers of a variable-stroke valve operating device into position in regard to their pivot points for a predetermined minimum stroke of all charge exchange valves, and coupling a camshaft with a drive device disposed in an apparatus and driving the camshaft at a predetermined rotary speed, while determining at least the valve strokes using extensometers drivingly connected to the moving charge exchange valves, which are displayed on a monitor with a given tolerance band and are furthermore documented.

* * * * *